US008764518B2

(12) United States Patent
McCutchen et al.

(10) Patent No.: US 8,764,518 B2
(45) Date of Patent: Jul. 1, 2014

(54) DUST SHROUD FOR A GRINDER

(75) Inventors: Travis D McCutchen, Owasso, OK (US); Clinton J McCutchen, Tulsa, OK (US)

(73) Assignee: Pathfinder Concepts, LLC, Kankakee, IL (US)

( * ) Notice: Subject to any disclaimer, the term of this patent is extended or adjusted under 35 U.S.C. 154(b) by 775 days.

(21) Appl. No.: 12/908,513

(22) Filed: Oct. 20, 2010

(65) Prior Publication Data

US 2011/0092141 A1 Apr. 21, 2011

Related U.S. Application Data

(60) Provisional application No. 61/253,525, filed on Oct. 21, 2009.

(51) Int. Cl.
*B24B 23/02* (2006.01)
*B24B 55/10* (2006.01)

(52) U.S. Cl.
USPC ..... 451/359; 451/456

(58) Field of Classification Search
USPC ..... 451/350–354, 356–359, 451, 452, 451/454–456
See application file for complete search history.

(56) References Cited

U.S. PATENT DOCUMENTS

| | | | | |
|---|---|---|---|---|
| 4,071,981 | A * | 2/1978 | Champayne | 451/357 |
| 4,434,587 | A * | 3/1984 | McDougall | 451/357 |
| 4,932,163 | A | 6/1990 | Chilton et al. | |
| 5,125,190 | A | 6/1992 | Buser et al. | |
| 5,609,516 | A | 3/1997 | Courson et al. | |
| 5,713,785 | A * | 2/1998 | Nishio | 451/451 |
| 5,791,979 | A | 8/1998 | Duncan et al. | |
| 6,027,399 | A | 2/2000 | Stewart | |
| 6,328,643 | B1 | 12/2001 | Huber | |
| 6,540,598 | B1 | 4/2003 | McCutchen | |
| 7,625,265 | B2 * | 12/2009 | Woods et al. | 451/451 |
| 7,887,395 | B2 * | 2/2011 | Weiford et al. | 451/359 |
| 8,137,165 | B2 * | 3/2012 | Loveless et al. | 451/456 |
| 2005/0239383 | A1 | 10/2005 | O'Shannessy | |

* cited by examiner

*Primary Examiner* — Timothy V Eley
(74) *Attorney, Agent, or Firm* — Faegre Baker Daniels LLP

(57) ABSTRACT

A dust shroud apparatus for a work tool includes a housing having at least two perpendicularly aligned side walls, an exhaust tube coupled to the housing, and a mounting system coupled to the housing. The mounting system is adjustable to permit the housing to be secured to a plurality of different sized work tools. The apparatus also includes a cut wheel having an outer edge substantially aligned with the at least two perpendicularly aligned side walls.

13 Claims, 4 Drawing Sheets

DUST SHROUD FOR A GRINDER

CROSS REFERENCE TO RELATED APPLICATION

This application claims the benefit of U.S. Provisional Application Ser. No. 61/253,525, filed on Oct. 21, 2009, which is expressly incorporated by reference.

BACKGROUND AND SUMMARY

The present disclosure relates to a dust shroud for a work tool. More particularly, the present disclosure relates to a dust shroud designed to be attached to an angle grinder or other suitable work tool in order to capture the dust and other debris generated while grinding, sanding or polishing various surfaces.

Conventional dust shrouds use different types of mounting adapters for different sized grinders. The dust shroud of the present disclosure includes a "one size fits all" mounting system. The adjustable mounting system allows the dust shroud to fit most commercially available angle grinders without requiring separate mounting equipment for each grinder. Commercially available grinders have bearing housings with many different mounting diameters, and the illustrated adjustable mounting system adapts to these different mounting diameters.

The dust shroud of the present disclosure is shaped to conform more closely to the geometry of the work environment, namely a generally rectangular or square shaped floor inside a room. In an illustrated embodiment, the dust shroud has a rectangular shape to fit into corners and edges of the work area. The dust shroud also extends downwardly close to the work surface to help deflect flying debris.

Conventional dust shrouds that provide a "zero edging" capability only provide that capability at one location, usually at the front of the shroud. The dust shroud of the present disclosure illustratively provides a zero edging capability along a front wall and two side walls of the shroud. The dust shroud of the present disclosure allows a user to grind into a corner and then move the grinder out perpendicularly out of the corner without picking up or turning the grinder.

The dust shroud of one illustrated embodiment of the disclosure includes a shroud housing having a rectangular or square geometric shape. The rectangular shaped shroud housing more closely matches a typical work area being ground, sanded or polished than conventional round dust shrouds. The rectangular shaped shroud housing is placed over a round cut wheel of the grinder so that the maximum area possible is ground in the created right angle.

In an illustrated embodiment, the corners of the rectangular housing are removed to allow grinding around odd shaped structures without affecting cornering capabilities. The dust shroud of an illustrated embodiment is capable of grinding to all the way to the front wall and two side walls while connected to an angle grinder.

The illustrated dust shroud includes an outer housing formed from a rigid material such as metal or a heavy duty plastic material. The dust shroud also includes a flexible, resilient seal that is adjustably attached to the housing via Velcro or other suitable fastener. The shroud illustratively achieves about 1/16" edging from three sides with the seal in place and zero edging on the three sides with the seal removed. The front two corners are cut back to an angle to provide edging around odd shaped items without affecting cornering capabilities.

According to an illustrated embodiment of the present disclosure, a dust shroud apparatus is provided for a work tool. The dust shroud includes a housing having at least two perpendicularly aligned side walls, an exhaust tube coupled to the housing, and a mounting system coupled to the housing. The mounting system is configured to secure the housing to the work tool. The apparatus also includes a cut wheel having an outer edge substantially aligned with the at least two perpendicularly aligned side walls.

In one illustrated embodiment, the apparatus further includes a seal coupled to the at least two perpendicularly aligned side walls of the housing. The seal is vertically adjustable relative to the housing to permit a bottom edge of the seal to be aligned with a floor. An illustrative embodiment of the seal includes an upper portion coupled to the housing and a lower portion. The lower portion of the seal is thinner than the upper portion to provide clearance between the seal and the outer edge of the cut wheel.

In an illustrated embodiment, the housing includes a front wall, a rear wall and first and second side walls which are aligned to form a rectangularly shaped housing. The outer edge of the cut wheel is substantially aligned with at least the front wall and the first and second side walls. The illustrated housing also includes first and second angled corner portions located between the front wall and the first and second side walls, respectively.

According to another illustrated embodiment of the present disclosure, a dust shroud apparatus is provided for a work tool. The dust shroud apparatus includes a housing having an interior region, an exhaust tube coupled to the housing in communication with the interior region, and a mounting system coupled to the housing. The mounting system is adjustable to permit the housing to be secured to a plurality of different sized work tools. The apparatus also includes a cut wheel located in the interior region of the housing.

In an illustrated embodiment, the housing includes a top surface having a central opening. The mounting system includes an annular collar coupled to the top surface of the housing surrounding the central opening and a plurality of cleats coupled to the annular collar. The plurality of cleats being radially adjustable to secure the housing to a portion of the work tool.

Additional features of the present system and method will become apparent to those skilled in the art upon consideration of the following detailed description of illustrative embodiments exemplifying the best mode of carrying out the present system and method as presently perceived.

BRIEF DESCRIPTION OF THE DRAWINGS

The foregoing aspects and other features of this disclosure will become more readily appreciated and better understood by reference to the following detailed description when taken in conjunction with the accompanying drawings in which.

DETAILED DESCRIPTION OF THE DRAWINGS

Figure 1:
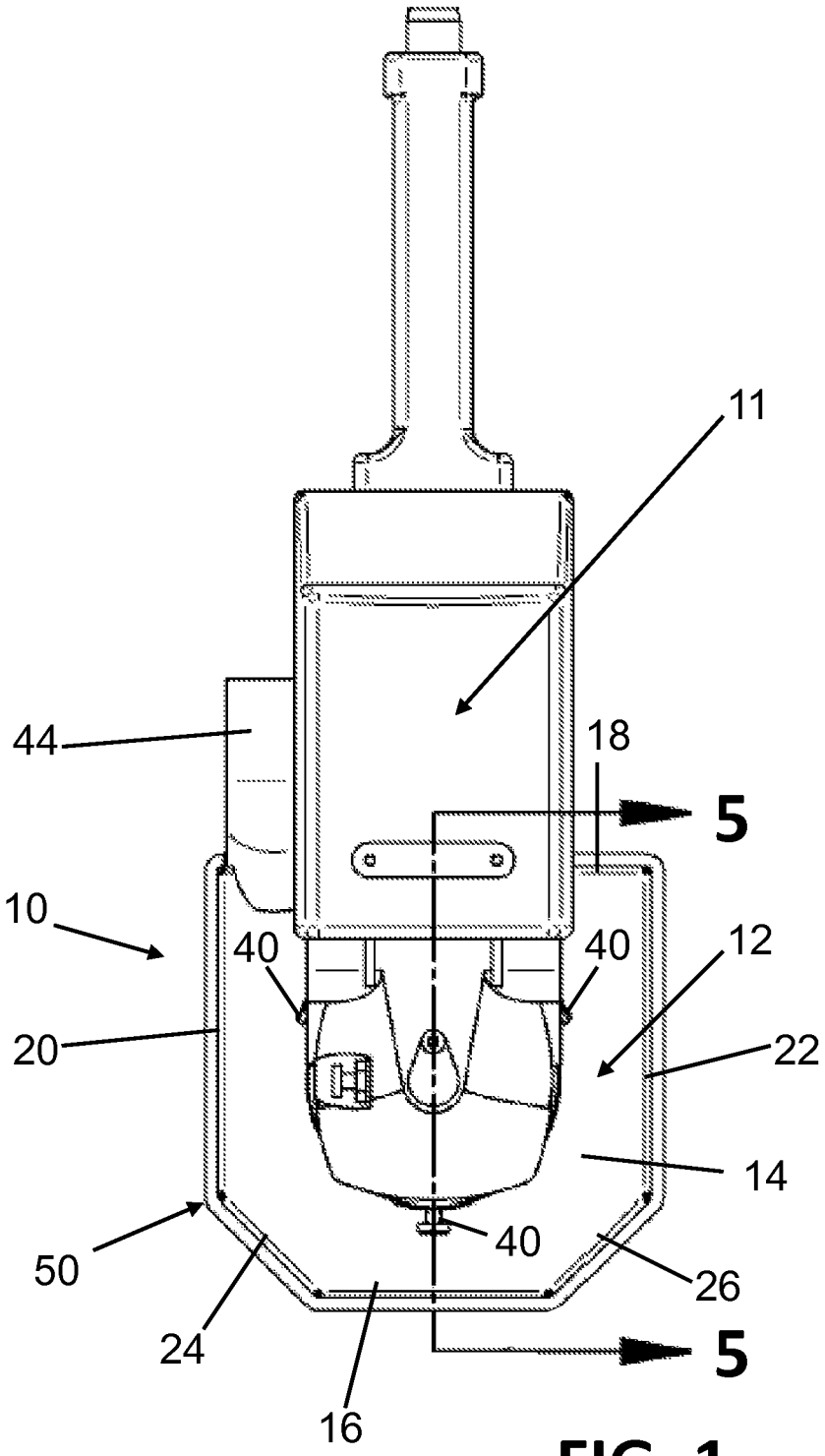
FIG. 1 is a top view illustrating a grinder coupled to a dust shroud of the present disclosure.
Figure 2:
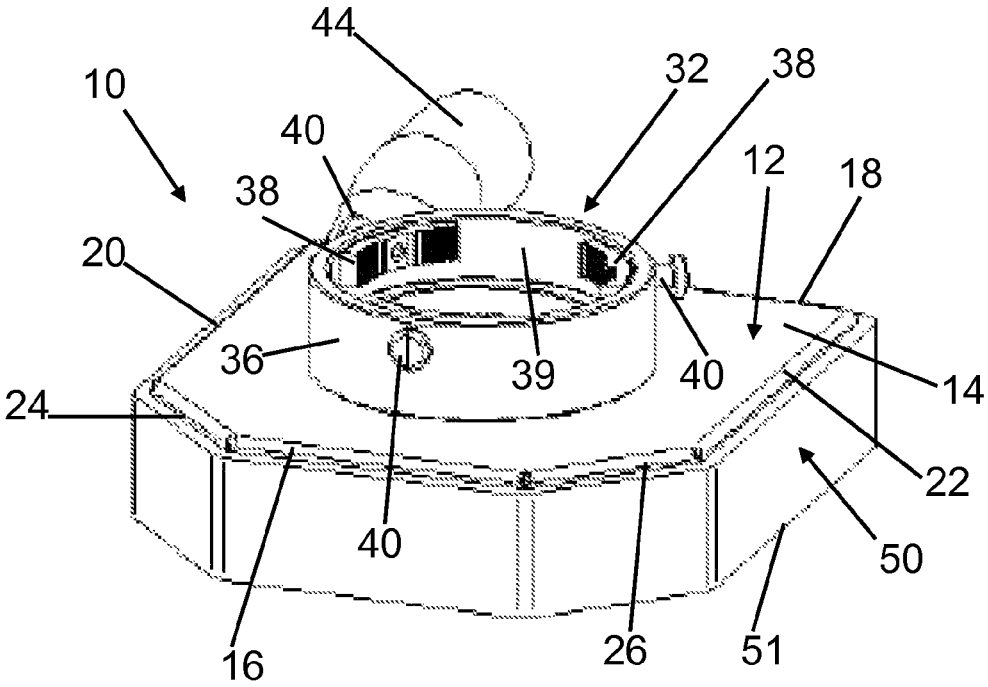
FIG. 2 is a front perspective view of the dust shroud of FIG. 1.
Figure 3:
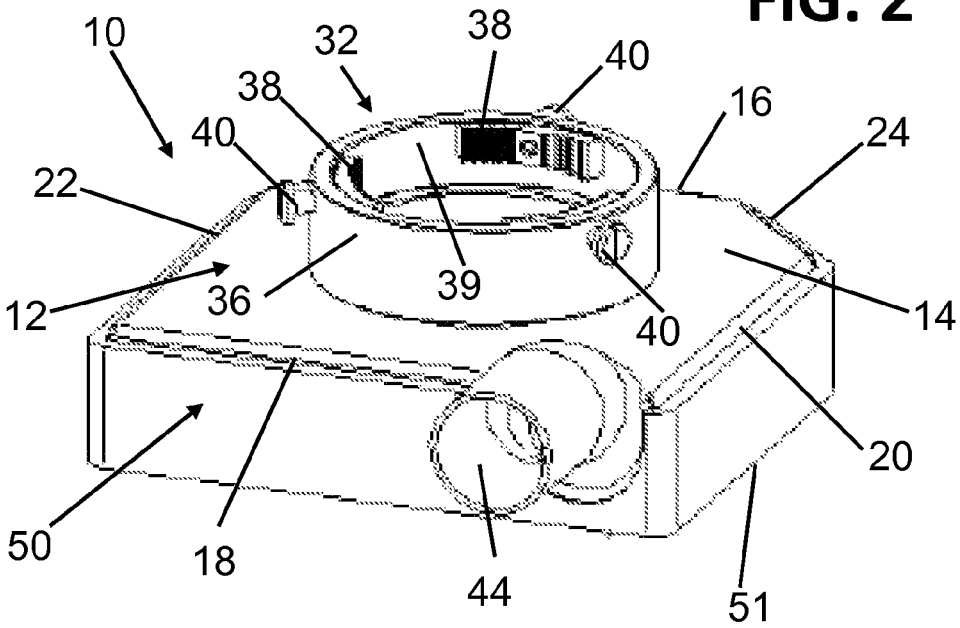
FIG. 3 is a rear perspective view of the dust shroud of FIGS. 1 and 2.

For the purposes of promoting an understanding of the principles of the present disclosure, reference will now be made to the embodiments illustrated in the drawings, which are described below. The embodiments disclosed below are not intended to be exhaustive or limit the disclosure to the precise form disclosed in the following detailed description. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of the principles of the invention which would normally occur to one skilled in the art to which the invention relates. Corresponding reference characters indicate corresponding parts throughout the several views.

FIG. 1 illustrates a dust shroud 10 for use with a work tool such as an angle grinder 11. The dust shroud 10 may be used with many conventional grinders, sanders and polishers and is not limited to the illustrated grinder 11. Typical angle grinders 11 have an abrasive disk or cut wheel 60 shown in FIGS. 4 and 5 for grinding a work surface such as concrete floor, for example. Such angle grinders 11 typically are connected to a vacuum operated dust collection system (not shown). Dust shroud 10 assists with collection of dust and other debris generated by the grinder 11.

The dust shroud 10 of the present disclosure includes a generally rectangular-shaped housing 12 having a top surface 14, a front wall 16, a rear wall 18, and laterally spaced apart side walls 20 and 22. In one embodiment, the housing 12 is fabricated from steel or other metal for increased durability. In another embodiment, the housing 12 is formed from a polymeric material using an injection molding or other forming process. Angled corner walls 24 and 26 are provided between the side walls 20 and 22, respectively, and the front wall 16. Top surface 14 includes a central opening 28 best shown in FIG. 4 which is configured to receive a portion of the grinder 11 therein. Top surface 14 also includes mounting apertures 30.

The dust shroud 10 of the present disclosure is equipped with an adjustable mounting system 32 that allows quick and easy mounting to several different types of angle grinders, sanders or polishers without the use of special fastening components customized for each specific work tool. Mounting system 32 is coupled to top surface 14 of housing 12 by fasteners 34 shown in FIGS. 4 and 5, which extend through apertures 30 of housing 12 and into an annual collar 36. In an illustrated embodiment, three mounting cleats 38 are coupled to the collar 36 by bolts or other suitable fasteners 40. In the illustrated embodiment, the cleats 38 provide an adjustable three point contact with an annular portion 42 of a bearing housing of grinder 11 as best shown in FIG. 5. A different number of cleats 38 may be used if desired, although three cleats 38 is the preferred number.

Adjustment of the fasteners 40 causes the cleats 38 to move radially inwardly or outwardly to accommodate grinders having different sized annular housing portions 42. Therefore, the adjustable mounting system 32 permits the dust shroud 10 to be coupled to many different sizes and styles of grinders, sanders or polishers without requiring separate mounting equipment customized for each work tool. Mounting system 32 allows the dust shroud 10 to be changed from grinder to grinder without purchasing specific mounts and eliminates the fit-up issue that most consumers experience with currently available dust shroud products.

Housing 12 also includes a vacuum or dust port coupled to an exhaust tube 44. The dust port is illustratively a 1.5" port allowing use of smaller hoses that provide ease of operation and maneuverability. Exhaust tube 44 may be coupled to a conventional vacuum system (not shown). Bottom edges of front wall 16 and side walls 20 and 22 of housing 12 are each formed to include a notched portion 46 which provide clearance for an edge portion 61 of the cut wheel 60 as best shown in FIG. 5.

A flexible outer seal 50 is configured to be coupled to an outer periphery of the housing 12. The seal 50 is illustratively made from rubber, polyurethane, or other suitable flexible and resilient material to provide a bumper or guard around the outer periphery of the housing 12. The seal 50 is preferably held together on the housing 12 by a Velcro fastener or other suitable fastener. As best shown in FIG. 5, the seal 50 includes a thicker upper portion 52 and thinner lower portion 54 to provide clearance for the edge portion 61 of the cut wheel 60.

The dust shroud 10 of an illustrated embodiment of the present disclosure is capable of edging to within very close tolerances (for example about 1/16 of an inch) of obstructions on three sides of the shroud with the seal 50 in place. The illustrated dust shroud 10 provides zero edging with the seal 50 removed as shown in FIG. 5.

Figure 4:
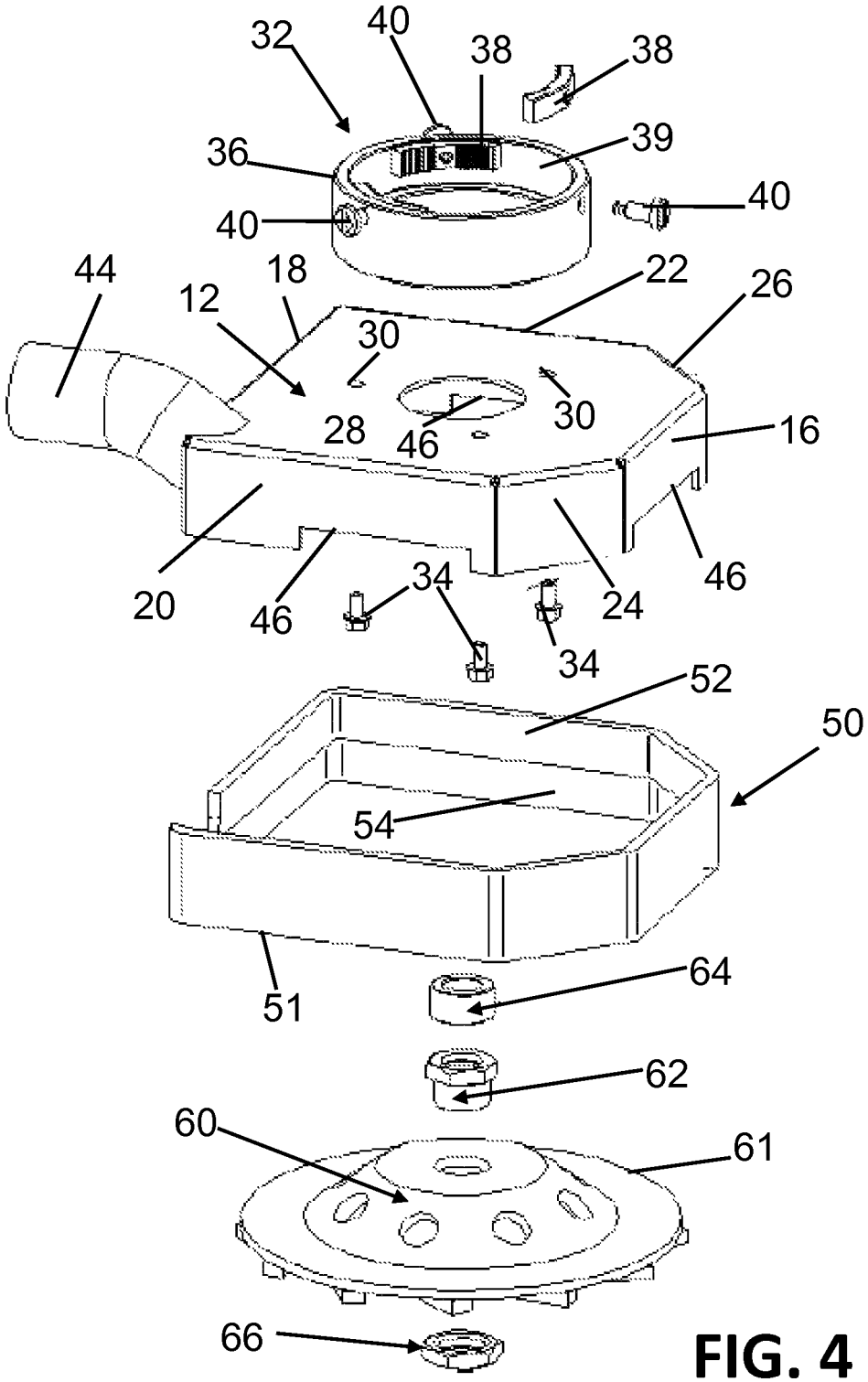
FIG. 4 is an exploded perspective view of a dust shroud of FIGS. 1-3.
Figure 5:
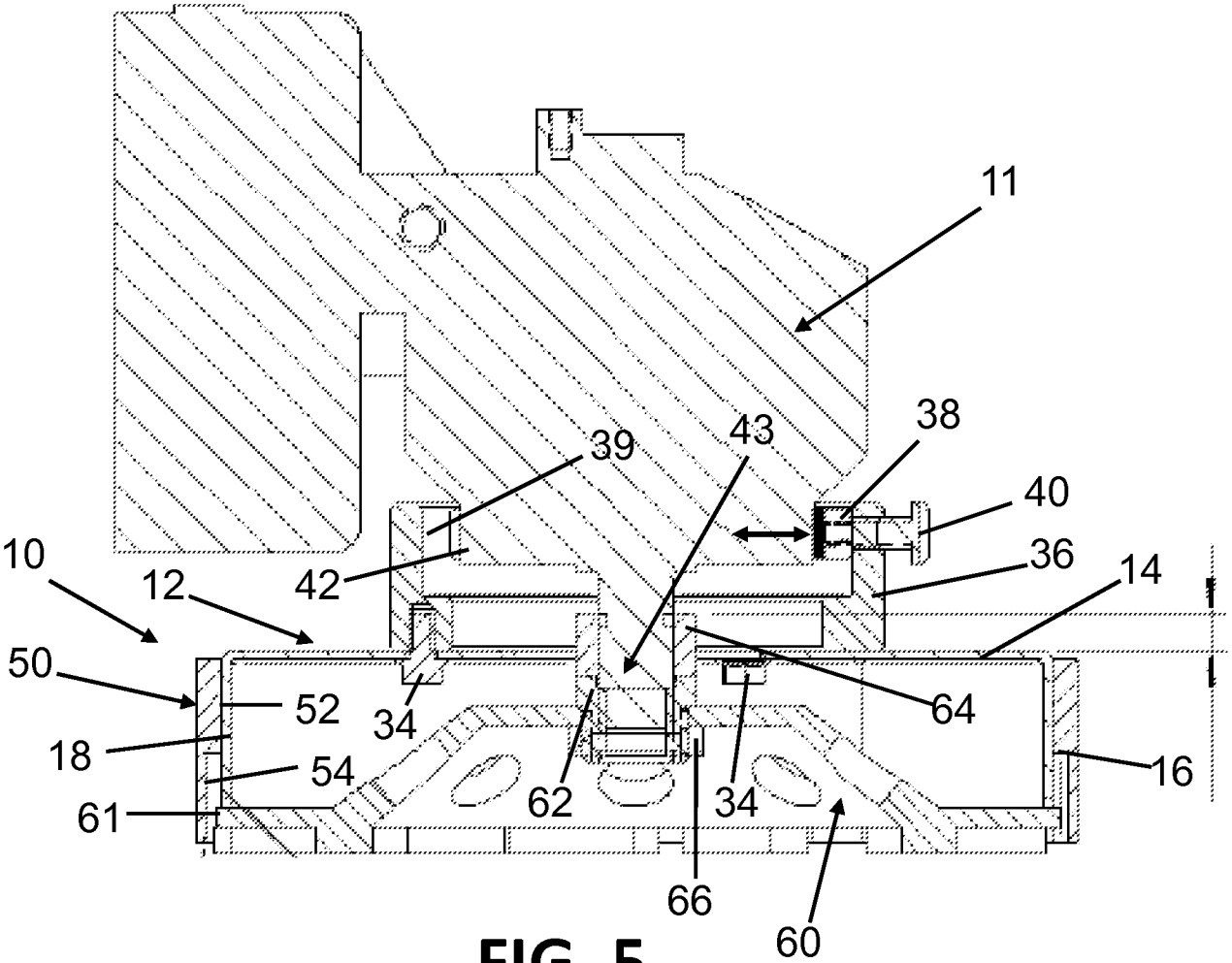
FIG. 5 is a sectional view taken along lines 5-5 of FIG. 1 illustrating further details of the dust shroud of FIGS. 1-4.

FIG. 4 illustrates the cut wheel 60, a wheel adapter 62, a spacer 64 and a fastening nut 66 to secure the cut wheel to the drive shaft 43 of the grinder 11. As shown in FIG. 5, the cut wheel 60 is mounted within the housing 12 of dust shroud 10 so that an edge portion 61 of the wheel 60 extends to front and rear walls 16 and 18 and the side walls 20 and 22 of the housing 12 to provide the "zero edging" feature.

In operation, the dust shroud 10 is installed onto the grinder 11 by turning the grinder 11 over so that the drive shaft 43 of grinder 11 faces upwardly. Initially, fasteners 40 are adjusted so that cleats 38 of the mounting system 32 are moved radially outwardly against an inner wall 39 of the annular collar 36. The collar 36 is located over the annular portion 42 of the bearing housing of grinder 11 with the drive shaft 43 centered within opening 28 in top surface 14. The fasteners 40 are then rotated to move the cleats 38 radially inwardly against the annular surface 42 of grinder 11 so that the drive shaft 43 remains centered within the central opening 28 of housing 12. Once the fasteners 40 are securely tightened, the housing 12 is rigidly coupled to the grinder 11.

Next, an appropriate spacer 64 is selected for the particular grinder 11. In an illustrated embodiment, two different sized spacers are included with the dust shroud 10. The spacers 64 and wheel adapter 62 are placed on the drive shaft 43 of grinder 11 as best shown in FIG. 5. The nut 66 is then coupled to the end of drive shaft 43 to secure the cut wheel 60 to the drive shaft 43 of grinder 11. Next, the grinder 11 is turned over so that the cut wheel 60 is located on the ground. The location of seal 50 is then adjusted vertically so that a bottom edge 51 of seal 50 engages the floor. Adjustments to the position of seal 50 are made by loosening the Velcro or other fastener which holds the seal 50 to the outer walls of housing 12.

The rectangular shape of dust shroud 10 allows the grinder 11 to move into corners of a room, and then move out of the corner perpendicularly without lifting or rotating the grinder. The angled corner walls 24 and 26 facilitate edging around odd-shaped items. The mounting system 32 of the dust shroud 10 permits the dust shroud 10 to be mounted to most 7-9 inch angle grinders without adding customized mounting components.

While this disclosure has been described as having exemplary designs and embodiments, the present invention may be further modified within the spirit and scope of this disclosure and the following claims. This application is therefore intended to cover any variations, uses, or adaptations of the disclosure using its general principles. Further, this application is intended to cover such departures from the present disclosure as come within known or customary practice in the art to which this disclosure pertains.

The invention claimed is:

1. A dust shroud apparatus for a work tool, the dust shroud apparatus comprising:

a housing having a front wall, a rear wall and first and second side walls which are aligned to form a rectangularly shaped housing, the front wall and the first and second side walls each being formed to include a notched portion located adjacent a bottom edge thereof, and the housing also including a top surface having a central opening;

an exhaust tube coupled to the housing;

a mounting system coupled to the housing, the mounting system including an annular collar coupled to the top surface of the housing surrounding the central opening and a plurality of cleats coupled to the annular collar, the plurality of cleats being radially adjustable to secure the housing to a portion of the work tool, thereby permitting the housing to be secured to a plurality of different sized work tools;

a cut wheel having an outer edge substantially aligned with at least the front wall and the first and second side walls of the housing, the notched portions of front wall and the first and second side walls providing clearance openings for the outer edge of the cut wheel; and a seal coupled to the front wall, the rear wall and the first and second side walls of the housing, the seal being vertically adjustable relative to the housing to permit a bottom edge of the seal to be aligned with a floor.

2. The apparatus of claim 1, wherein the seal includes an upper portion coupled to the housing and a lower portion, the lower portion of the seal being thinner than the upper portion to provide clearance between the seal and the outer edge of the cut wheel.

3. The apparatus of claim 1, wherein the housing includes first and second angled corner portions located between the front wall and the first and second side walls, respectively.

4. The apparatus of claim 1, wherein the seal extends around an entire periphery of the housing.

5. The apparatus of claim 1, further comprising a spacer, a wheel adapter, and a nut configured to be coupled to a drive shaft of the work tool to secure the cut wheel to the drive shaft.

6. A dust shroud apparatus for a work tool, the dust shroud apparatus comprising:

a housing having at least two perpendicularly aligned side walls, the at least two perpendicularly aligned side walls each being formed to include a notched portion located adjacent a bottom edge thereof;

an exhaust tube coupled to the housing;

a mounting system coupled to the housing, the mounting system being configured to secure the housing to the work tool; and a cut wheel having an outer edge substantially aligned with the at least two perpendicularly aligned side walls, the notched portions of the at least two perpendicularly aligned side walls providing clearance openings for the outer edge of the cut wheel.

7. The apparatus of claim 6, further comprising a seal coupled to the at least two perpendicularly aligned side walls of the housing, the seal being vertically adjustable relative to the housing to permit a bottom edge of the seal to be aligned with a floor.

8. The apparatus of claim 7, wherein the seal extends around an entire periphery of the housing and includes an upper portion coupled to the housing and a lower portion, the lower portion of the seal being thinner than the upper portion to provide clearance between the seal and the outer edge of the cut wheel.

9. The apparatus of claim 6, wherein the housing includes a front wall, a rear wall and first and second side walls which are perpendicularly aligned to form a rectangularly shaped housing, the outer edge of the cut wheel being substantially aligned with at least the front wall and the first and second side walls, and wherein the front wall and the first and second side walls each include a notched portion located adjacent a bottom edge thereof, the notched portions providing clearance openings for the outer edge of the cut wheel.

10. The apparatus of claim 9, wherein the housing includes first and second angled corner portions located between the front wall and the first and second side walls, respectively.

11. The apparatus of claim 6, wherein the mounting system is adjustable to permit the housing to be coupled to a plurality of different sized work tools.

12. The apparatus of claim 11, wherein the housing includes a top surface having a central opening, and wherein the mounting system includes an annular collar coupled to the top surface of the housing surrounding the central opening and a plurality of cleats coupled to the annular collar, the plurality of cleats being radially adjustable to secure the housing to a portion of the work tool.

13. The apparatus of claim 6, further comprising a spacer, a wheel adapter, and a nut configured to be coupled to a drive shaft of the work tool to secure the cut wheel to the drive shaft.

* * * * *